United States Patent [19]

Scheidegger

[11] Patent Number: 4,497,156

[45] Date of Patent: Feb. 5, 1985

[54] METHOD OF AND APPARATUS FOR ENVELOPING MOVING ARTICLES

[75] Inventor: Albert Scheidegger, Villeurbanne, France

[73] Assignee: ETS Scheidegger W. & Cie, Villeurbanne, France

[21] Appl. No.: 421,242

[22] Filed: Sep. 22, 1982

[51] Int. Cl.[3] ..... B65B 13/00; B65B 53/02

[52] U.S. Cl. ..... 53/399; 53/293; 53/295; 53/296; 53/442; 53/557

[58] Field of Search ..... 53/291, 292, 293, 294, 53/295, 296, 397, 399, 557, 442; 493/408, 409, 410, 310, 357, 356; 156/86

[56] References Cited

U.S. PATENT DOCUMENTS

| | | | |
|---|---|---|---|
| 4,238,267 | 12/1980 | Konstantin | 53/292 X |
| 4,293,364 | 10/1981 | Fujio | 156/86 X |
| 4,318,685 | 3/1982 | Konstantin | 53/292 X |

*Primary Examiner*—Robert L. Spruill
*Assistant Examiner*—Richard M. Mudd
*Attorney, Agent, or Firm*—Karl F. Ross; Herbert Dubno

[57] ABSTRACT

In order to envelop the necks of a series of continuously moving bottles with decorative or informative tubular attachments, an elongate tube of heat-shrinkable plastic material is flattened first in one longitudinal plane and then in another longitudinal plane, perpendicular to the former, to produce a sheath with two substantially flat sides bearing the traces of a first pair of creases while being bounded by a second pair of creases. The longitudinally advancing sheath is cut into clippings of predetermined length that are advanced codirectionally therewith but at higher speed along a sloping guidepath in which the existing creases are caused to converge while the original creases reappear as the two sides are progressively spread apart. At a point where the creases of the two pairs are separated by substantially the same distance at a leading end of a clipping, the latter meets the neck of an oncoming bottle at an obtuse angle to its direction of motion whereby a remote edge of that leading end is engaged and tilts the clipping into a vertical position in which it slides down the neck. A subsequent heat treatment shrinks the clipping around that neck as a tightly fitting collar or jacket.

18 Claims, 7 Drawing Figures

METHOD OF AND APPARATUS FOR ENVELOPING MOVING ARTICLES

FIELD OF THE INVENTION

My present invention relates to a method of and an apparatus for at least partly enveloping a series of substantially identical articles in motion, e.g. bottles which are carried on a continuously advancing conveyor and whose necks are to be fitted with decorative or informative tubular attachments that are subsequently fastened in position thereon by a heat-shrinking operation.

BACKGROUND OF THE INVENTION

It is known to decorate various articles—e.g. bottles—with collars of heat-shrinkable plastic material such as polyethylene that are cut from a flattened tubing or sheath and are subsequently reopened to regain their original shape; the articles fitted with these collars then pass through a heating zone where the collars are tightly shrunk around them.

According to an earlier invention of mine, disclosed in French patent application No. 77.12126 of Apr. 18, 1977, now publication 2,387,900 the reopening of the flattened clippings to form the collars is facilitated by initially compressing the sheath in one longitudinal plane to form a first pair of parallel creases or fold lines and thereafter deforming the sheath with substantial elimination of these creases and compression of the sheath in another longitudinal plane, perpendicular to the preceding one, to produce the tubing to be cut which is characterized by two flat sides bounded by a second pair of creases; the traces of the first pair of creases, extending along centerlines of these flat sides, facilitate the separation of the two sides from each other when pressure is applied to the second pair of creases.

Even with this improvement, however, conventional techniques do not readily lend themselves to a mode of operation enabling such collars to be slipped onto the neck of an oncoming bottle while the latter is moving even at moderate speed. Conventional equipment for partially or completely enshrouding moving bottles or other support elements with collars or jackets of heat-shrinkable plastic or any other material therefore generally require a slow and intermittent motion of a conveyor entraining such support elements, thus resulting in a low output rate, unless a complex turntable arrangement is used for the cutting and transfer mechanisms.

OBJECTS OF THE INVENTION

An important object of my invention, therefore, is to provide a method of fitting bottles or other articles with tubular attachments of the type referred to while these articles are in continuous and fairly rapid motion.

A related object is to provide a simple apparatus for carrying out this method.

SUMMARY OF THE INVENTION

In accordance with one aspect of my present invention, a flattened deformable sheath of indefinite length is advanced along a guidepath descending toward a row of moving support elements to be fitted with tubular clippings cut therefrom, the sheath having major sides which are bounded by a pair of longitudinal creases and are separable from each other in a transverse direction. The sheath is cross-cut at an intermediate point of its guidepath into successive clippings of predetermined length, each freshly cut clipping being advanced at an increased speed along a stretch of the guidepath narrowing in an axial plane which includes the aforementioned creases whereby the sides of the clipping are progressively separated until their transverse spacing substantially equals the distance between the creases at a leading end of the clipping, i.e. until that distance has been reduced in a ratio of approximately $1:\sqrt{2}$ from its original value so that this leading end has a generally square configuration. The descending clipping is thereupon discharged from its guidepath at an obtuse angle to the direction of motion of the support elements at a level at which a remote edge of its leading end (as viewed in the direction of motion of the support elements) is met by an upright part of an oncoming support element—e.g. the neck of a bottle—with a cross-sectional area smaller than that of the leading end of the clipping whereby the latter is erected and comes to rest around that upright part.

In some instances the support elements receiving the transversely expanded clippings may be intermediate carriers, rather than the bottles or other articles having necks to be enveloped, which move along a closed trajectory tangent to a substantially horizontal line of motion of the articles themselves whose rate of displacement is synchronized with that of the carriers to facilitate a transfer of each clipping from any carrier to the neck of a respective article. The use of these intermediate carriers may be advantageous, for example, if the clippings have a height less than their width and could not be safely intercepted by necks passing horizontally under the structure defining the sloping guidepath.

In either case, the sheath to be sectioned into clippings preferably consists of heat-shrinkable plastic material so that a collar or jacket constituted by each transversely expanded clipping can be thermally fixed to the enshrouded article or part thereof as is well known per se. I also prefer to preform the sheath in the manner described in my above-identified French patent application, i.e. to start with tubing initially flattened in a first longitudinal plane and subsequently reflattened in a second longitudinal plane perpendicular thereto so that the original fold lines substantially disappear, leaving only traces midway of the sides of the sheath and of its clippings which are bounded by the creases produced during reflattening. During the subsequent expansion step, the original fold lines reappear to define with those creases the sides of a generally tetrahedral body whose cross-sectional area progressively increases in the direction of advance.

Pursuant to another aspect of my invention, the sheath and its clippings are advanced by transport means comprising a pair of counterrotating feed rollers engageable with the major sheath sides, at a location ahead of a pair of guide members partly defining the path of advance, and a driver positively engageable with the clippings in the region of these guide members; the sectioning of the sheath perpendicularly to its creases is accomplished by cutter means preferably including one or more peripheral blades on at least one of two counterrotating cylinders. These cylinders and the two feed rollers operate at a peripheral speed less than the speed imparted to the resulting clippings by the driver. The two guide members have crease-engaging zones converging in the direction of advance, these zones being separated from each other at a discharge end of the guidepath by a distance which is related to their distance in the vicinity of the cutter means by the aforementioned ratio of approximately $1:\sqrt{2}$ as to let each clipping emerge from the discharge end with a generally square leading end as noted above. The trailing end of each clipping will be generally rhomboidal, though the difference may be minimal in the case of collars of low height which, in fact, will be inverted and deposited on the receiving articles by their trailing ends if intermediate carriers are used for the transfer. The guide members advantageously slope toward a lower level on which the support elements are continuously advanced by suitable conveyor means to intercept the descending clippings as discussed above; in principle, however, these members could also be vertical if the clippings are to be deposited on support elements whose motion is interrupted during such deposition.

BRIEF DESCRIPTION OF THE DRAWING

These and other features of my present invention will now be described in detail with reference to the accompanying drawing wherein.

SPECIFIC DESCRIPTION

Figures 1, 4, 5:
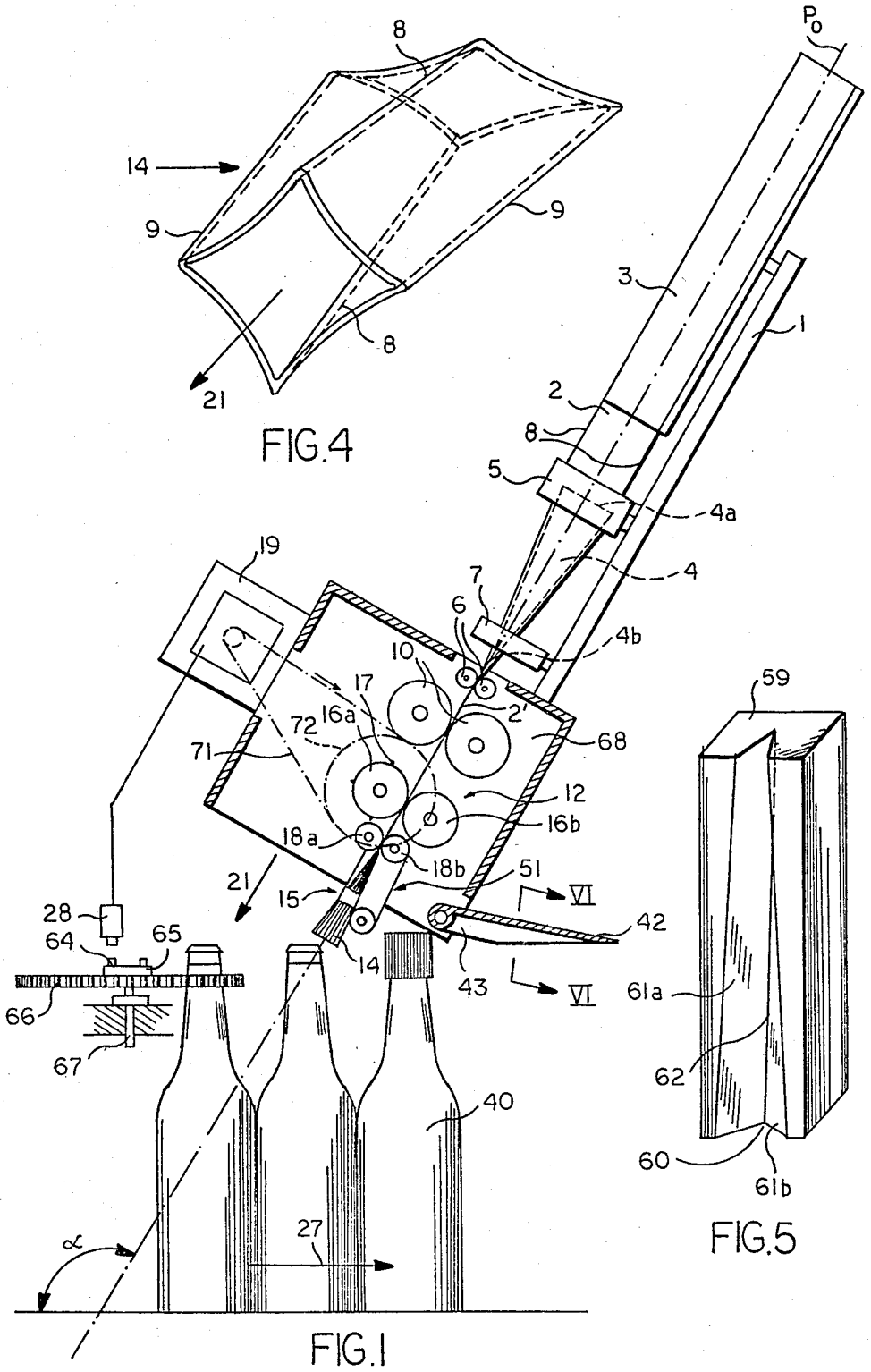
FIG. 1 is a somewhat diagrammatic elevational view of an apparatus for fitting moving bottles with tubular attachments according to the present invention.
FIG. 4 is a perspective view of a clipping discharged by the transport mechanism, drawn to a larger scale.
FIG. 5 is an enlarged perspective view of a V-grooved guide member coacting with the transport mechanism of FIGS. 1, 2 and 3.
Figure 2:
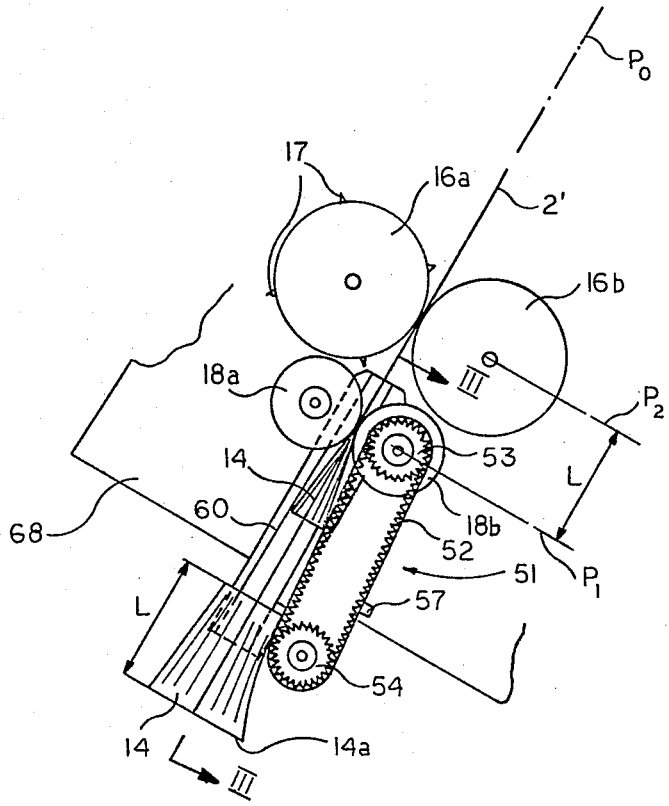
FIG. 2 is an enlarged elevational view of a transport mechanism included in the apparatus of FIG. 1.
Figure 3:
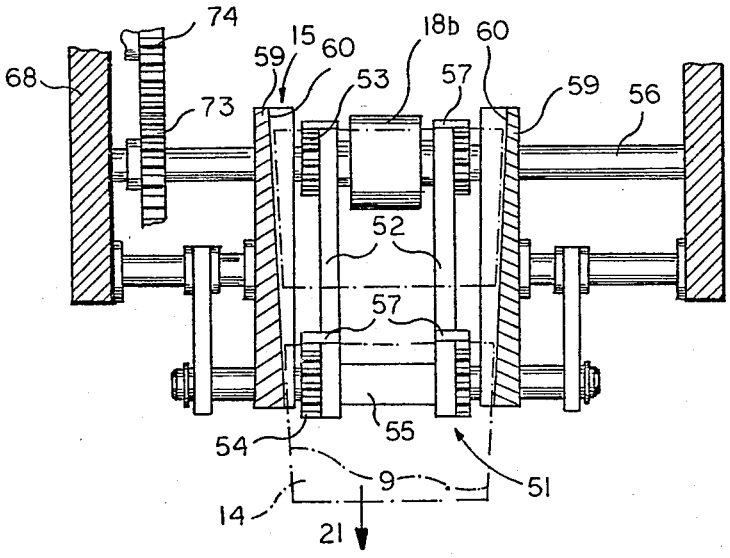
FIG. 3 is a partly sectional view of the transport mechanism taken substantially along the line III—III of FIG. 2.

The apparatus shown in FIGS. 1, 2 and 3 comprises a fixed frame represented only by a transmission housing 68 and a mounting plate 1 rising therefrom at an inclination of about 30° to the vertical. A reel 3 journaled at the top of plate 1 is formed by convolutions of a flattened tubing 2 of thermally shrinkable plastic material, e.g. polyethylene, bounded by a pair of longitudinal creases 8. Tubing 2 is drawn intermittently from reel 3 by a pair of counterrotating feed rollers 10 driven by a stepping motor 19 via a transmission of which only a chain 71 and a sprocket 72 have been illustrated; the axes of feed rollers 10 are perpendicular to the flat sides of tubing 2 and are offset by 90° from the axes of a first pair of guide rollers 5 in the vicinity of the reel while being parallel to the axes of a second pair of guide rollers 6 downstream of rollers 5. A polyhedral core 4, of the type described in my above-identified French patent application No. 77.12126, extends between these two pairs of guide rollers and is enveloped by the tubing to convert it into a sheath 2' with substantially flat sides in a longitudinal plane $P_0$ perpendicular to that of the original tubing. Thus, core 4 has two opposite triangular faces diverging from an upper transverse edge **4*a*, disposed with small clearance between rollers 5, to a transverse downstream edge 4*b* which is skew to edge 4*a* and lies with small clearance between rollers 6; two other opposite triangular faces of core 4 converge from the upstream edge 4*a* to the downstream edge 4*b*. These latter faces are bracketed by a further pair of guide rollers 7, with axes parallel to those of rollers 5, designed to hold the floatingly suspended core in position within plane $P_0$ through the intermediary of the enveloping sheath. Guide rollers 6 and feed rollers 10 substantially eliminate the original creases 8**, leaving only traces thereof along centerlines of its flat sides.

Rollers 5 and 7 are supported on plate 1 whereas rollers 6 and 10 are mounted inside the transmission housing 68.

Motor 19 further drives two counterrotating cylinders **16*a*, 16*b* on opposite sides of plane $P_0$ which have the same diameter as rollers 10 and rotate at the same speed. Cylinder 16*a*, which together with its mate 16*b* forms part of a cutting mechanism 12, carries several peripherally equispaced blades 17 (four in the present instance) which extend parallel to its axis and serve to sever the oncoming sheath 2' into successive clippings 14 whose length is determined by the spacing of these blades. Two additional rollers 18*a* and 18*b*, with axes parallel to those of feed rollers 10 and cylinders 16*a*, 16*b*, are disposed on opposite sides of plane $P_0$ downstream of these cylinders; their axes lie in a transverse plane $P_1$ (FIG. 2) separated from another transverse plane $P_2$, containing the axes of cylinders 16*a* and 16*b*, by a distance L not greater than the length of a clipping 14 in order to engage the leading end of that clipping as soon as it is severed from the sheath 2' by a blade 17. The two cylinders 16*a* and 16*b* are spaced apart by the thickness of sheath 2' which also corresponds to the height of the blades; taller blades could, of course, be used on cylinder 16*a* if the companion cylinder 16*b*** has peripheral grooves confronting these blades. It will also be readily apparent that both cylinders could be equipped with such blades, e.g. in interleaved relationship.

If the length of a clipping 14 exceeds the circumference of a cutting cylinder that can be conveniently accommodated on housing 68, these cylinders would have to be driven by motor 19 at a reduced speed via a step-down transmission.

Rollers **18*a* and 18*b* form part of a transport mechanism, generally designated 51, which further includes a pair of endless bands 52 (best seen in FIG. 3) with internal teeth each engaging a notched upstream pulley 53 and a notched downstream pulley 54, the latter idling on a shaft 55 supported by arms 58. Pulleys 53 are keyed to a shaft 56 that also carries the roller 18*b* as well as a gear 72 in mesh with another gear 74 which form part of a step-up drive imparting to the bands 52 a linear speed substantially exceeding the peripheral speed of rollers 10 and cylinders 16*a*, 16*b***, e.g. by a factor of 2.

The bands 52 are externally provided with spaced-apart flights 57 whose separation is greater than the length L of a clipping 14. Roller **18*b* has a radius exceeding that of pulleys 53 by approximately the height of these flights 57 which therefore project close to the circumference of that roller when passing around the upstream pulleys. Thus, the bands 52 constitute a pair of flight conveyors with parallel runs approaching the plane $P_0$ from the side of roller 18*b*, i.e. from the right as seen in FIGS. 1 and 2; these runs, moreover, diverge from that plane at a small angle in the direction of advance, represented by an arrow 21**, for reasons that will become apparent hereinafter.

A guide structure 15 near the lower end of transmission housing 68 comprises two parallel members 59 bracketing the conveyors 52, 57 between them. Each guide member 59 is provided with a longitudinally extending V-groove 60, flanked by cheeks 61*a* and 61*b* as best seen in FIG. 5, whose bottom 62 defines with these cheeks a zone designed to engage one of the two longitudinal creases of a clipping cut from sheath 2'; these two creases, indicated at 9 in FIG. 3 and also in FIG. 4, are seen to converge toward each other in the direction of advance 21. This convergence is due to the fact that, as will be apparent from FIG. 3, the two grooves 60 grow progressively shallower in the direction of advance so that their bottoms 62 approach each other; on the other hand, and as likewise best seen in FIG. 5, the grooves 60 widen progressively as the angle included by their flanks 61*a*, 61*b* increases. An initially flat clipping 14 driven by a pair of flights 57 on the two bands 52, bearing upon a trailing edge of that clipping in the vicinity of its creases 9, thus becomes progressively deformed as its sides separate from each other under the pressure exerted upon these creases while the original creases or fold lines 8 of tubing 2 begin to reappear and diverge concurrently with the convergence of creases 9. The aforementioned inclination of the proximal runs of bands 52 to the plane of advance $P_0$ allows for the transverse expansion of each clipping 14 while maintaining the driving engagement between two of its rear edges and respective flights 57.

The shape of grooves 60 and the length of the guidepath defined by members 59 are so chosen that a clipping 14 leaving that guidepath, as shown in FIG. 2, has a generally rhomboidal trailing end and a substantially square leading end as seen in FIG. 4. Since the clipping is substantially flat when first engaged by the guide members 59, the separation of the groove bottoms should vary from their upper to their lower ends in a ratio of roughly $\sqrt{2:1}$.

Figure 6:
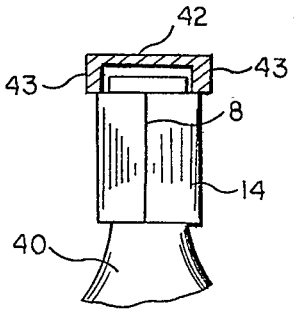
FIG. 6 is a fragmentary sectional view taken substantially along the line VI—VI of FIG. 1.

In FIG. 1 I have further illustrated a series of articles 40, specifically bottles, moving steadily in a horizontal line as indicated by an arrow 27 so that their direction of motion includes an obtuse angle $\alpha$ with the sheath plane $P_0$ and thus with the direction of advance 21 of the clippings 14. These bottles are displaced by suitable drive means shown to include a starwheel 66 with a vertical shaft 67 rotated by a nonillustrated motor. Starwheel 66, whose peripheral notches accommodate the necks of bottles 40 passing by, has a hub 65 carrying two metallic studs 64 which pass under an electromagnetic sensor 28 whenever one of the bottles 40 approaches the discharge end of guide structure 15. Sensor 28 (which could also be of the photoelectric type) thereupon generates a pulse stepping the motor 19 to advance the sheath 2' by the length L of a clipping 14 whereby one such clipping is released from its guide path in the direction of the approaching bottle. As the discharged clipping meets the oncoming bottle, the top of the bottle strikes a remote edge 14*a* (FIG. 2) of its leading end so as to erect that clipping as the bottle passes underneath. Since the expanded leading end of the clipping has an internal width somewhat larger than the diameter of the bottle top, the descending clipping drapes itself around the neck of the bottle. A fixed but preferably adjustable guide element 42 of inverted-U profile has flanks 43 straddling the neck of the advancing bottle, as best seen in FIG. 6, which cam the clipping 14 further down the neck to the desired extent. A subsequent heat treatment, e.g. in a heating chamber 74 as shown in FIG. 7, then shrinks the clipping around the neck of the bottle into a firmly adherent collar.

Figure 7:
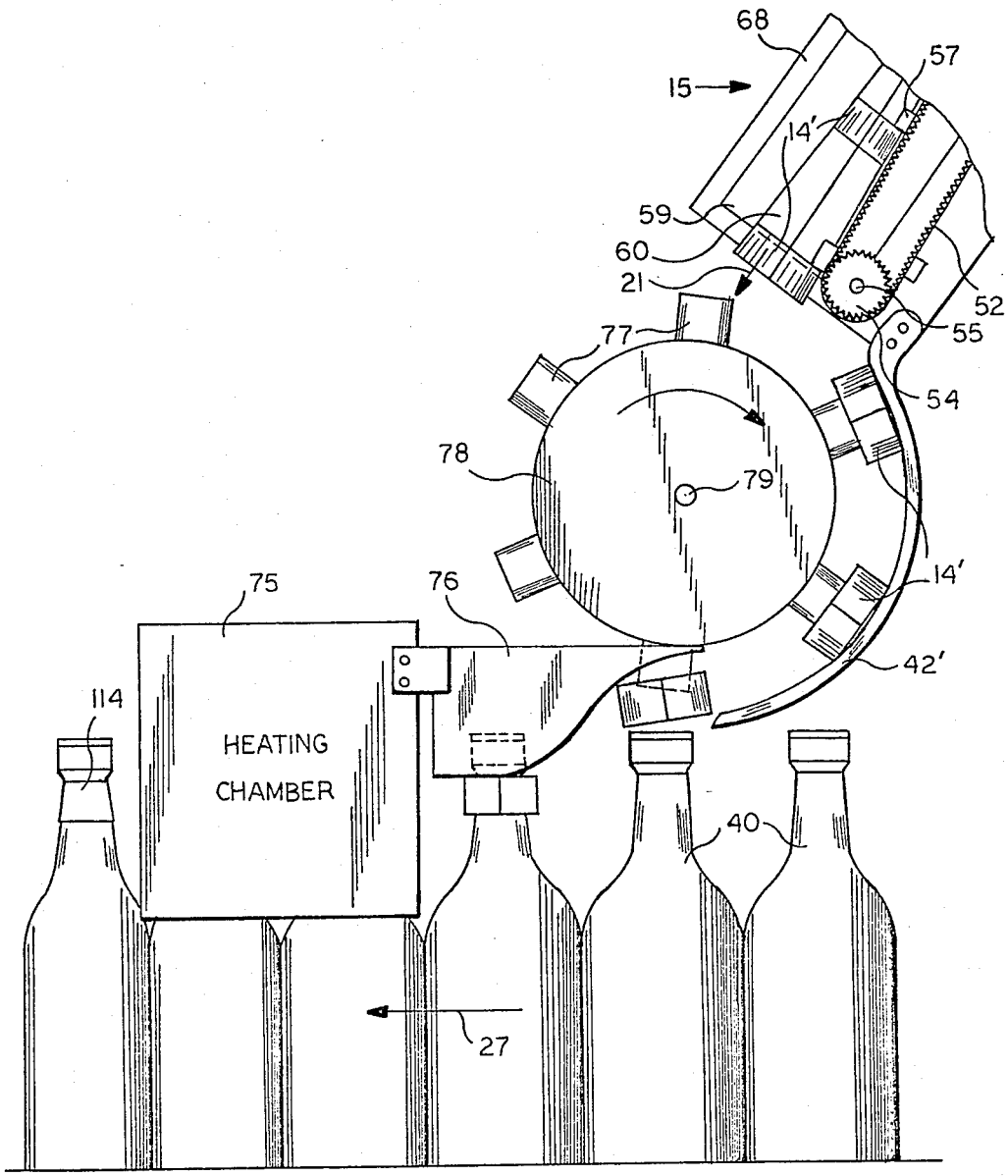
FIG. 7 is a fragmentary elevational view of a modification of the apparatus of FIG. 1.

In FIG. 7 I have illustrated the lower part of the apparatus of FIGS. 1–3 in a case where the clippings to be produced, here designated 14', are considerably reduced in height so that the oncoming bottles 40 moving on the level of FIG. 5 would not clear the guide structure 15 if their tops were to be close enough to the discharge end of the guidepath to receive each clipping immediately after its release by the flight conveyors 52, 57. The apparatus therefore is provided with a transfer wheel 78, rotating on a horizontal shaft 79 in synchronism with the bottle drive, which carries a plurality of angularly equispaced peripheral bosses 77 of substantially the same diameter as the bottle tops. As each clipping 14' descends toward wheel 78, a boss 77 strikes the remote edge of its leading end whereby the clipping comes to rest on the boss on which it is retained by a curved guide element 42 until it reaches a bottom position just above the top of a bottle 40 moving past. A stationary deflector 76 then detaches the oncoming clipping 14' from its supporting boss 77 and transfers it to the neck of the bottle 40 aligned therewith. After emerging from the heating chamber 75, the clipping has the shape of a round collar 114.

It will be apparent that the method and apparatus according to my invention could also be used to produce clippings of greater length, designed to form jackets around at least a major part of an article to be enshrouded thereby.

Rollers 5, 6, 7 and core 4 will be omitted if the sheath payed out by the reel 2 is already preshaped in the manner described.

I claim:

1. A method of fitting a series of continuously moving support elements with tubular attachments enveloping same at least in part, comprising the steps of:

(a) providing a flattened deformable sheath of indefinite length having two major sides bounded by a pair of longitudinal creases, said sides being separable from each other in a transverse direction;

(b) advancing said sheath along a guidepath descending toward a row of said moving support elements;

(c) cross-cutting the advancing sheath at an intermediate point of said guidepath into successive clippings of predetermined length;

(d) advancing each freshly cut clipping at a higher speed than said sheath along a stretch of said guidepath narrowing in an axial plane including said creases, with resulting progressive separation of said sides from each other until their spacing in said transverse direction substantially equals the distance between said creases at a leading end of the clipping; and (e) discharging each descending clipping from said guidepath at an obtuse angle to the direction of motion of said support elements at a level at which a remote edge of the leading end thereof is met by an upright part of an oncoming support element with a cross-sectional area smaller than that of said leading end whereby the descending clipping is erected and comes to rest around said upright part.

2. A method as defined in claim 1 wherein step (a) includes an initial flattening of said sheath to form a pair of fold lines in a plane perpendicular to said axial plane, followed by a reflattening of said sheath in said axial plane to form said major creases while leaving only traces of said fold lines midway on the major sides bounded by said creases, said fold lines reappearing in step (d) and defining with said creases the lateral faces of a generally tetrahedral body with a cross-sectional area progressively increasing in the direction of advance.

3. A method as defined in claim 1 or 2 wherein said support elements are erect articles traveling in a substantially horizontal line of motion beneath a discharge end of said guidepath.

4. A method as defined in claim 3 wherein said sheath consists of heat-shrinkable plastic material, comprising the further step of subjecting each of said articles beyond its point of encounter with a descending clipping to a heat treatment for shrinking such clipping around the part enveloped thereby.

5. A method as defined in claim 1 or 2 wherein said support elements are intermediate carriers moving along a closed trajectory tangent to a substantially horizontal line of motion of erect articles with necks to be enveloped by said clippings, the motions of said carriers and said articles being synchronized to facilitate a transfer of each clipping from any of said carriers to the neck of a respective article.

6. A method as defined in claim 5 wherein said sheath consists of heat-shrinkable plastic material, comprising the further step of subjecting each of said articles beyond its point of contact with a transferred clipping to a heat treatment for shrinking such clipping around the neck enveloped thereby.

7. In an apparatus for fitting a succession of movable support elements with tubular attachments enveloping at least parts of said support elements, including supply means for paying out a flattened deformable sheath of indefinite length with two transversely separable major sides bounded by a pair of longitudinal creases, transport means for advancing said sheath along a predetermined path, and cutter means for sectioning the advancing sheath perpendicularly to said creases into clippings of uniform length expandable transversely to said major sides, the improvement wherein said path is defined downstream of said cutter means by a pair of guide members with crease-engaging zones converging in the direction of advance, said transport means comprising a pair of counterrotating feed rollers engageable with said major sides at a location upstream of said cutter means and a driver positively engageable with said clippings in the region of said guide members for advancing said clippings between said converging surfaces at a speed higher than the peripheral speed of said feed rollers, said converging zones being separated from each other at a discharge end of said path by a distance related in a ratio of approximately $1:\sqrt{2}$ to the distance separating said converging zones in the vicinity of said cutter means whereby a clipping exiting from said path has a leading end of substantially square configuration.

8. An apparatus as defined in claim 7 wherein said converging zones are formed by V-grooves in said guide members widening progressively in the direction of advance.

9. An apparatus as defined in claim 8 wherein said guide members are parallel to each other, said V-grooves being of progressively decreasing depth in the direction of advance.

10. An apparatus as defined in claim 9 wherein said driver comprises a pair of parallel flight conveyors disposed between said guide members with runs each closely adjoining a flank of a respective V-groove thereof.

11. An apparatus as defined in claim 10 wherein said flight conveyors are internally toothed endless bands wound about coaxial pairs of first notched pulleys close to said cutter means and second notched pulleys close to said discharge end, said transport means further including an additional roller coaxially interposed between said first pulleys and a counterroller coacting with said additional roller, said additional roller being of larger diameter than said first pulleys, said bands carrying flights which project close to the circumference of said additional rollers on passing around said first pulleys.

12. An apparatus as defined in claim 7, 8, 9, 10 or 11 wherein said supply means comprises a reel paying out said sheath in the form of a flattened tubing bounded by a pair of fold lines in a first longitudinal plane transverse to the axes of said feed rollers, a first pair of guide rollers on opposite sides of said first longitudinal plane bracketing said tubing between them, and a second pair of guide rollers between said first guide rollers and said feed rollers with axes parallel to those of said feed rollers for reflattening said tubing in a second longitudinal plane perpendicular to said first longitudinal plane to form said longitudinal creases while substantially suppressing said fold lines.

13. An apparatus as defined in claim 12, further comprising a third pair of guide rollers parallel to said second pair of rollers and interposed between the latter and said first pair of rollers, the rollers of said third pair being spaced apart in said second longitudinal plane by a polyhedral core with mutually skew upstream and downstream edges respectively parallel to and inserted between the rollers of said first and second pairs, said sheath passing around said core between said first, second and third pairs of rollers.

14. An apparatus as defined in claim 7, 8, 9, 10 or 11, further comprising drive means for continuously advancing the support elements to be fitted with said attachments at a level below said transport means, said guide members sloping toward said level at an obtuse angle to the direction of motion of said support elements to facilitate a deposition of each discharged clipping on a receiving part of an oncoming support element.

15. An apparatus as defined in claim 14, further comprising stationary guide means extending in the direction of motion of said support elements beyond the discharge end of said path for camming a clipping deposited on any of said elements into a firm enveloping position thereon.

16. An apparatus as defined in claim 14, further comprising sensing means adjacent a line of motion of said support elements for detecting the approach of each support element to the discharge end of said path and synchronizing the operating rate of said cutter and transport means with the motion of said support elements.

17. An apparatus as defined in claim 14 wherein said drive means includes a transfer wheel rotatable about a horizontal axis, said support elements being peripheral bosses on said transfer wheel positioned to receive said clippings from said discharge end and depositing the received clippings on erect articles passing in a row underneath said transfer wheel in synchronism with the rotation thereof.

18. An apparatus as defined in claim 7, 8, 9, 10 or 11 wherein said cutter means comprises a pair of cylinders on opposite sides of said path counterrotating at the same peripheral speed as said feed rollers, at least one of said cylinders being provided with a peripheral blade extending along a generatrix thereof for contact with the opposite cylinder.

* * * * *